US006571763B1

(12) United States Patent
Bakker

(10) Patent No.: US 6,571,763 B1
(45) Date of Patent: Jun. 3, 2003

(54) OIL CONDITIONER

(75) Inventor: Emile A. M. Bakker, Ortonville, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/036,086

(22) Filed: Dec. 27, 2001

(51) Int. Cl.[7] ..... F02F 7/00
(52) U.S. Cl. ..... 123/195 R
(58) Field of Search ..... 123/195 R, 193.1, 123/41.31, 41.42

(56) References Cited

U.S. PATENT DOCUMENTS

RE34,139 E * 12/1992 Cooper et al. ..... 123/193.6

* cited by examiner

*Primary Examiner*—Tony M. Argenbright
*Assistant Examiner*—Katrina B. Harris
(74) *Attorney, Agent, or Firm*—Edwin W. Bacon, Jr.

(57) ABSTRACT

An internal combustion engine is provided having an engine block operably engaged with at least one cylinder head for defining an oil conditioning system therein. The oil conditioning system includes a series of oil and coolant flow channels running through the engine block, an oil trough formed within a central portion of the engine block and in fluid communication with an oil pan for collecting oil therein. Oil flows from the oil pan and into the cylinder head for lubricating components therein. The oil drains from the cylinder head into the oil trough which is in heat exchange relationship with various coolant flow channels for heating or cooling the oil flowing through the oil trough. The oil then drains from the oil trough back to the oil pan.

5 Claims, 5 Drawing Sheets

OIL CONDITIONER

FIELD OF THE INVENTION

The present invention relates to engine blocks and more particularly to an engine block having an oil conditioning system formed therein.

BACKGROUND OF THE INVENTION

Internal combustion engines (ICEs) are commonly known in the art. Generally, ICEs operate by drawing a fuel/air mixture into a cylinder through an intake valve of a cylinder head. The fuel/air mixture is combusted in the cylinder to drive a piston downward therein. The piston is connected to a crankshaft by a connecting rod. The downward driving force of the piston rotatably drives the crankshaft for propelling a vehicle. The combusted gases within the cylinder head are driven out an exhaust valve of the cylinder head through a subsequent piston stroke.

An ICE at rest is generally at ambient temperature and, thus, all of the components, seals, lubricating oil, coolant and the like are also at ambient temperature. For proper engine operation, the lubricating oil is preferably at a temperature higher than ambient. At initial start-up, time is required to achieve a desired operational temperature for the lubricating oil by heating the lubricating oil through transferring heat generated through the combustion process. During this warm-up period, however, the ICE is operating with lubricating oil at a temperature less than the desired operational temperature, thereby adversely affecting the various components of the ICE. Additionally, traditional ICEs provide limited temperature control of the lubricating oil during operation of the ICE. Thus, it may occur that the lubricating oil achieves a temperature greater than the desired operational temperature. In order to remedy this, a separate oil cooler is sometimes implemented, thereby increasing cost, weight and required packaging envelope.

A further disadvantage of traditional ICEs is the return flow of the lubricating oil from the cylinder heads. Generally, the lubricating oil drips from the cylinder heads along exterior block wall passages, which increase packaging size and have no thermal exchange function. Such a configuration is common for overhead camshaft ICE designs. Alternatively, for push-rod valve actuation ICEs, oil flows down the interior of the engine block, often dripping directly onto the spinning crankshaft. As a result, the oil dripping onto the crankshaft is splattered within the interior of the engine block, causing the oil to foam and lose its lubricity. This can result in damage to the various bearings of the ICE.

Therefore, it is desirable in the industry to provide an oil-flow system for an ICE engine that enables quicker warm-up of the lubricating oil at start-up and regulates the oil temperature during normal ICE operation without requiring external components. The oil-flow system should also include an oil-dump passage for avoiding dripping of return oil on the crankshaft.

SUMMARY OF THE INVENTION

Accordingly, the present invention provides an internal combustion engine including a cylinder head having a first coolant flow channel formed therein and a first oil flow channel formed therein, an engine block, and an oil pan. The engine block includes a plurality of cylinders and a plurality of crank case bays, each crank case bay corresponding to at least one of the plurality of cylinders. The engine block further includes a second coolant flow channel formed adjacent to the cylinders, an oil trough formed adjacent to the second coolant flow channel and in heat transfer relationship therewith, and an oil return flow channel formed therein for providing fluid communication between the first oil flow channel of the cylinder head and the oil trough. The oil return flow channel is adjacent to the second coolant flow channel and is in heat transfer relationship therewith. The engine block further includes an oil dump flow channel formed therein for providing fluid communication from the oil trough. The oil pan is in sealed engagement with the engine block and in fluid communication with the oil dump flow channel. The oil pan collects oil, wherein the oil is pumped to the first oil flow channel of the cylinder head and flows from the cylinder head through the oil return flow channel and into the oil trough for heat transfer with coolant in the second coolant flow channel before returning to the oil pan through the oil dump flow channel.

The present invention further provides a plurality of venting channels formed within the engine block, each providing fluid communication between the plurality of crank case bays and the oil trough, wherein the venting channels enable pressurized fluid flow to the oil trough for equalizing pressure across the plurality of crank case bays. This enables bulkhead vent size to be reduced, thereby improving engine block strength.

The present invention may further include an inlet manifold in fluid communication with the cylinder head and an oil separator providing fluid communication between the oil trough and the inlet manifold for enabling pressure flow into the inlet manifold, thereby assisting crankcase ventilation to the inlet manifold. In this manner, blow-by gases, typically escaping between the cylinder walls and pistons after combustion, are relieved. Further, the separator collects oil droplets from the engine vapor and drains the collected oil back to the trough to prevent entrance into the inlet manifold, which would otherwise result in unwanted pollutants upon combustion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
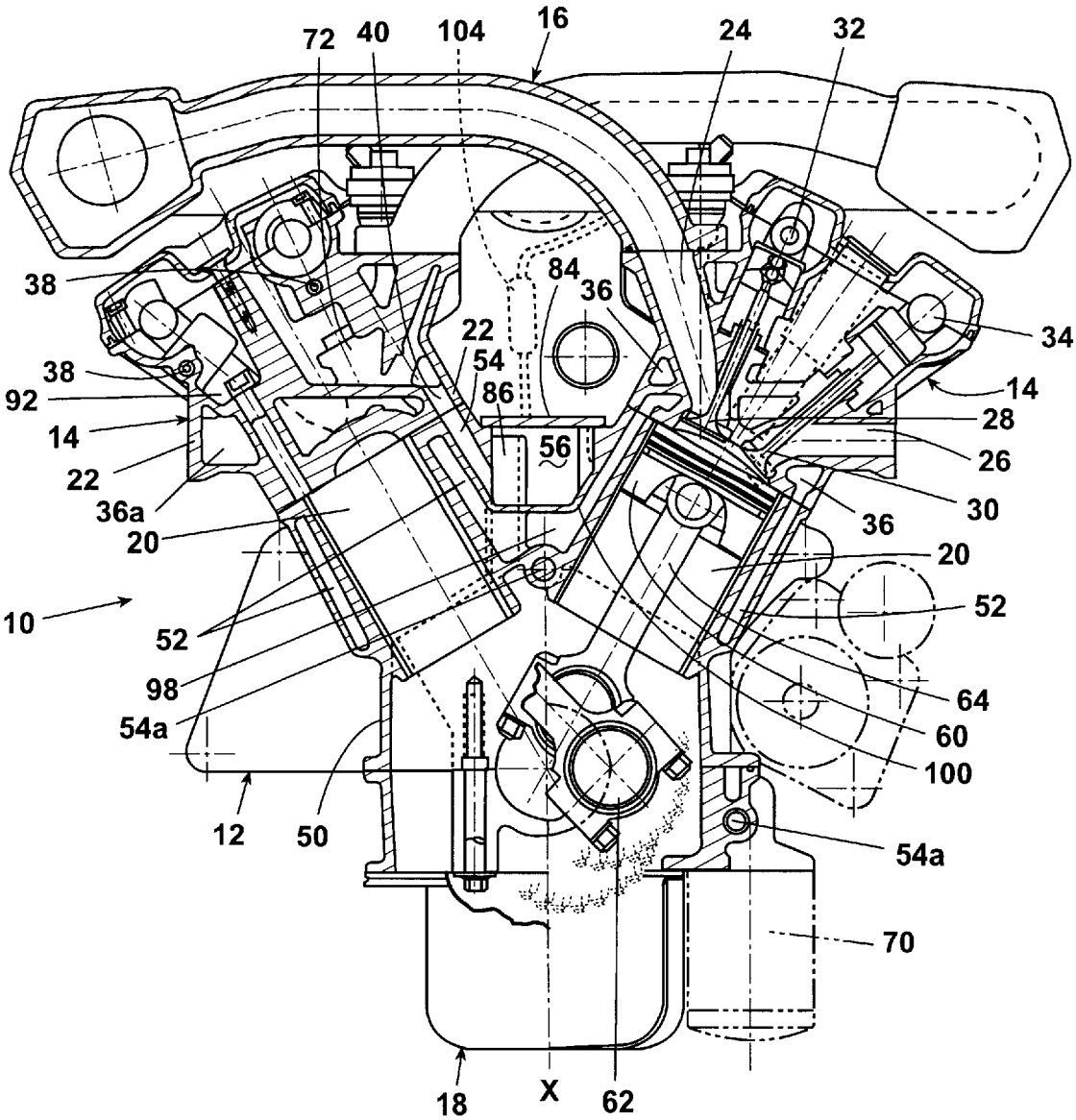
FIG. 1 is a cross-sectional view detailing an internal combustion engine having an engine block with an oil conditioning system formed therein, in accordance with the principles of the present invention.
Figure 2:
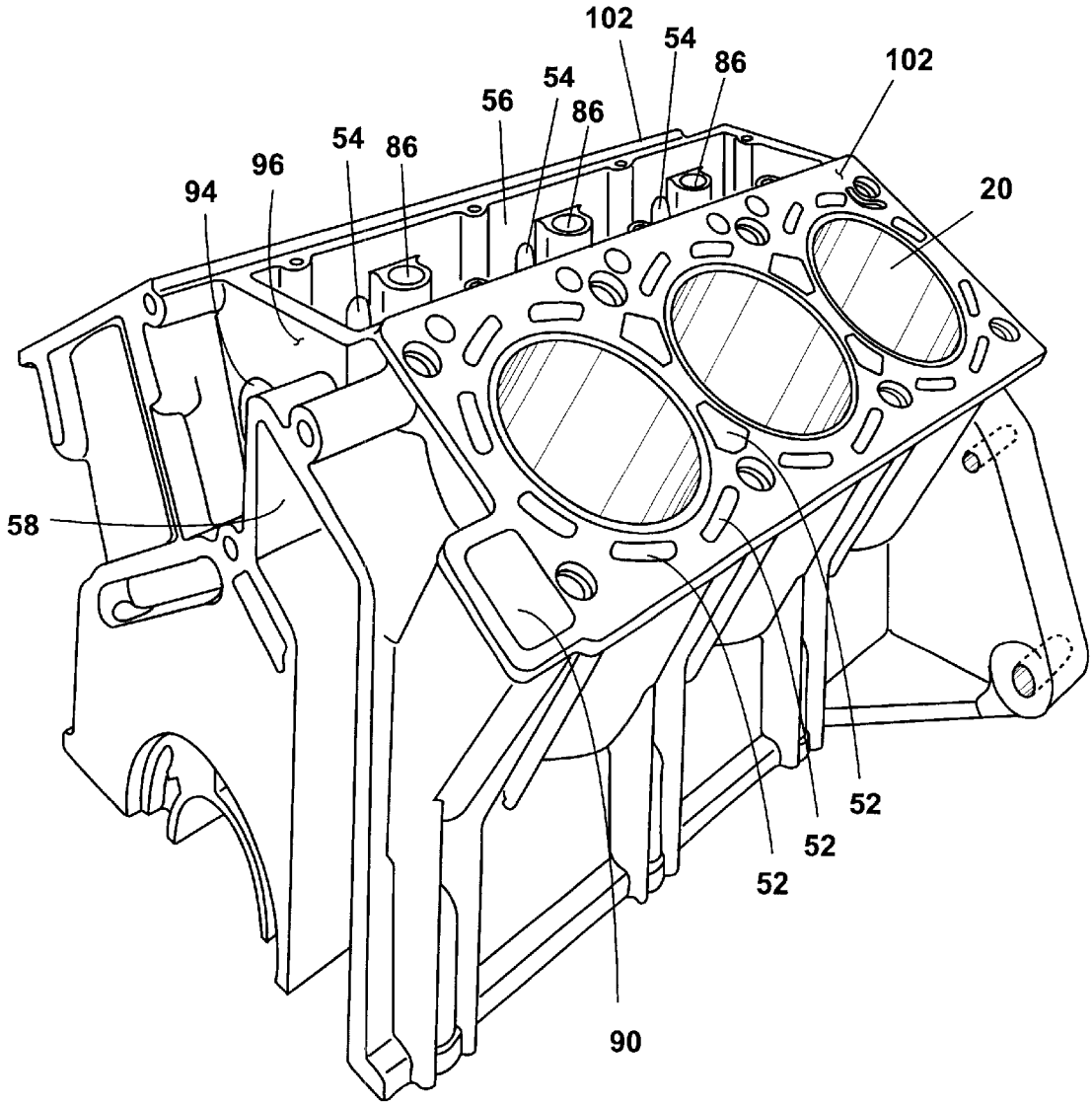
FIG. 2 is a perspective view of the engine block.
Figure 3:
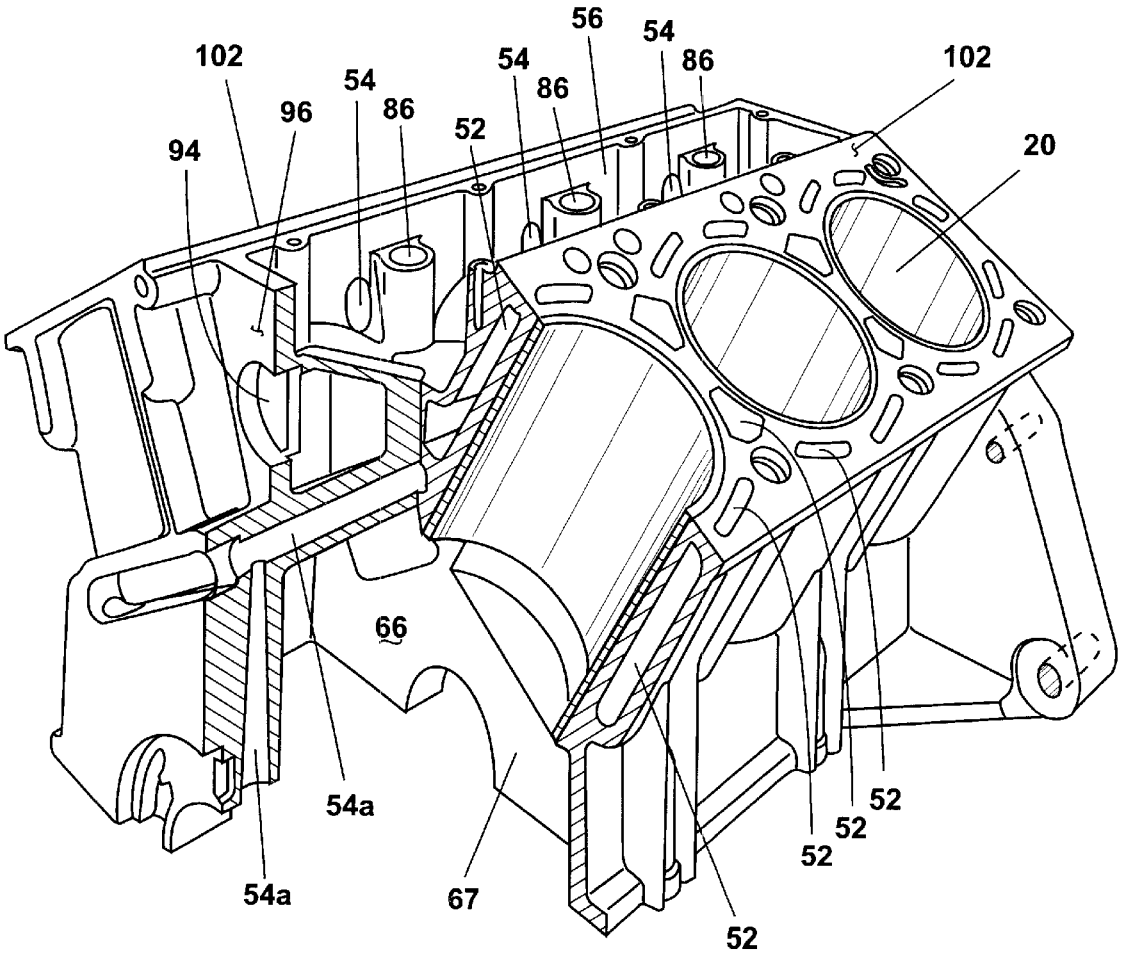
FIG. 3 is a perspective view of the engine block having a cutaway section detailing the oil conditioning system.

As shown in FIG. 1, an internal combustion engine (ICE) 10 is provided. The ICE 10 includes an engine block 12, a pair of cylinder heads 14 attached thereto, an intake manifold 16 attached to the cylinder heads 14, and an oil pan 18 attached to a bottom of the engine block 12. As is known in the art, the intake manifold 16 enables a flow of air into the cylinder heads 14 to mix with fuel injected therein and for intake into a plurality of combustion chambers (cylinders) 20 of the engine block 12. This fuel/air mixture is combusted within the individual combustion chambers 20 to produce a driving force and the combusted gases are exhausted back out the cylinder heads 14 to an exhaust flow path 26. The ICE 10 of the present invention includes an oil conditioning system including a series of oil and coolant flow channels, as detailed herein. The oil conditioning system enables improved warm-up time of oil within the ICE 10 and improved cooling of the oil during normal operation at increased engine loads.

The cylinder heads 14 generally include a body portion 22 having a series of intake flow paths 24 and exhaust flow paths 26 formed therein. A series of intake valves 28 and exhaust valves 30 are operably disposed within the cylinder heads 14 and selectively block the intake and exhaust flow paths 24,26, respectively. Each cylinder head 14 includes an intake cam 32 and an exhaust cam 34 that are in respective operable communication with the intake and exhaust valves. As the intake and exhaust cams 32,34 are caused to rotate, the intake and exhaust valves 28,30 are actuated to selectively enable fluid flow through the respective intake and exhaust flow paths 24,26.

A series of coolant flow channels 36 are formed within the cylinder heads 14 for cooling the various components of the cylinder heads 14, the combustion chambers 20 of the engine block 12 and the exhaust flow paths 26 of the cylinder heads 14. The coolant flow channels 36 of the cylinder heads 14 are in fluid communication with respective coolant flow channels of the engine block 12, as discussed in further detail herein. A series of oil flow channels 38 are formed within the cylinder heads 14 for lubricating the various components therein. Similar to the coolant flow channels 36, the oil flow channels 38 are in fluid communication with respective oil flow channels of the engine block 12. The oil flow channels 38 communicate with oil return flow channels 40 associated with each cylinder 20 through valve train housing 72. As discussed in further detail below, oil flowing through the cylinder heads 14 is directed back into the engine block 12 through the oil return flow channels 40.

As detailed in FIGS. 1 through 5, the engine block 12 includes the plurality of combustion chambers 20, a crank case 50, a series of coolant flow channels 52, a series of oil flow channels 54, an oil trough 56, and an oil dump flow channel 58, all of which are formed therein. As shown in the figures, the oil flow channels 54 are circular in shape; however, it is anticipated that alternative shapes may be provided for maximizing oil flow therethrough. The engine block 12 may be formed using a forming process such as, but not limited to, die-casting, semi-permanent mold (aluminum) and sand casting (cast iron). It will be appreciated that, while the present embodiment includes six combustion chambers 20, the ICE 10 may include more or fewer combustion chambers 20 as a function of desired output and design. The plurality of combustion chambers 20 are configured in a V-formation, whereby half of the plurality of combustion chambers 20 extend angularly upward towards one side of the engine block 12 and the remaining plurality of combustion chambers 20 extend angularly upward toward an opposing side.

A piston 60 is slidably disposed within each combustion chamber 20 and connects to a crankshaft 62 via a respective connecting rod 64. The crank shaft 62 runs through the crank case 50, which is divided into a plurality of crank case bays 66. The crank case bays 66 are generally defined by bulkheads 67 within the crank case 50 and are associated with opposing pairs of pistons 60, as is typical for V-configured ICEs. For example, for a four-cylinder ICE, two crank case bays 66 are provided, for a six-cylinder ICE, three, and so on. FIG. 1 depicts a crank case bay 66 within which a pair of connecting rods 64 operably attach to the crankshaft 62. Inline configured ICEs, however, typically include one bay per cylinder. It should be kept in mind though, that ICE performance and thus, crankshaft load determine the number of main bearings (not shown) and in turn, bulkheads for a given ICE.

In general, oil collects within the oil pan 18 and is pumped upward at high pressure through the engine block 12 and cylinder heads 14 by an oil pump (not shown). The oil flow channels 54 of the engine block 12 include a series of high pressure oil flow channels 54*a*, supplying oil to the cylinder heads 14 through an oil filter 70. Within the cylinder heads 14, the oil lubricates the intake and exhaust cams 32,34 in addition to various seals and other components therein. The oil then collects within cavities 72 of the cylinder heads 14 to drain back to the engine block 12 through the oil return flow channels 40.

The engine block 12 includes a valley area formed between the opposing cylinder heads, within which is disposed below the oil trough 56. The engine block 12 includes oil return flow channels 54 in fluid communication with the oil trough 56, whereby each is associated with the oil return flow channels 40 of the cylinder heads 14. In this manner, oil from the cylinder heads 14 drains through the oil return flow channels 54 to the oil trough 56. The oil trough 56 is covered by a cover 84 bolted to the engine block 12. In addition to sealing the oil trough 56, the cover 84 can be a structural member, providing support and structural integrity to the ICE 10.

A series of venting channels 86 are provided and correspond to the crank case bays 66. The venting channels 86 enable fluid communication between the oil trough 56 and the respective crank case bays 66 for equalizing any pressure difference that may occur between crank case bays 66. A pressure difference can occur when pistons 60 concurrently achieve their respective downstrokes. The downstrokes increase pressure, via displacement of crankcase volume, within the particular crank case bays 66 and thus, this pressure can be equalized across the crank case 50 via pressure flow through the venting channels 86 and the oil trough 56. It should be noted that the traditional crank case venting methods may be implemented with the venting channel configuration of the present invention.

Figure 4:
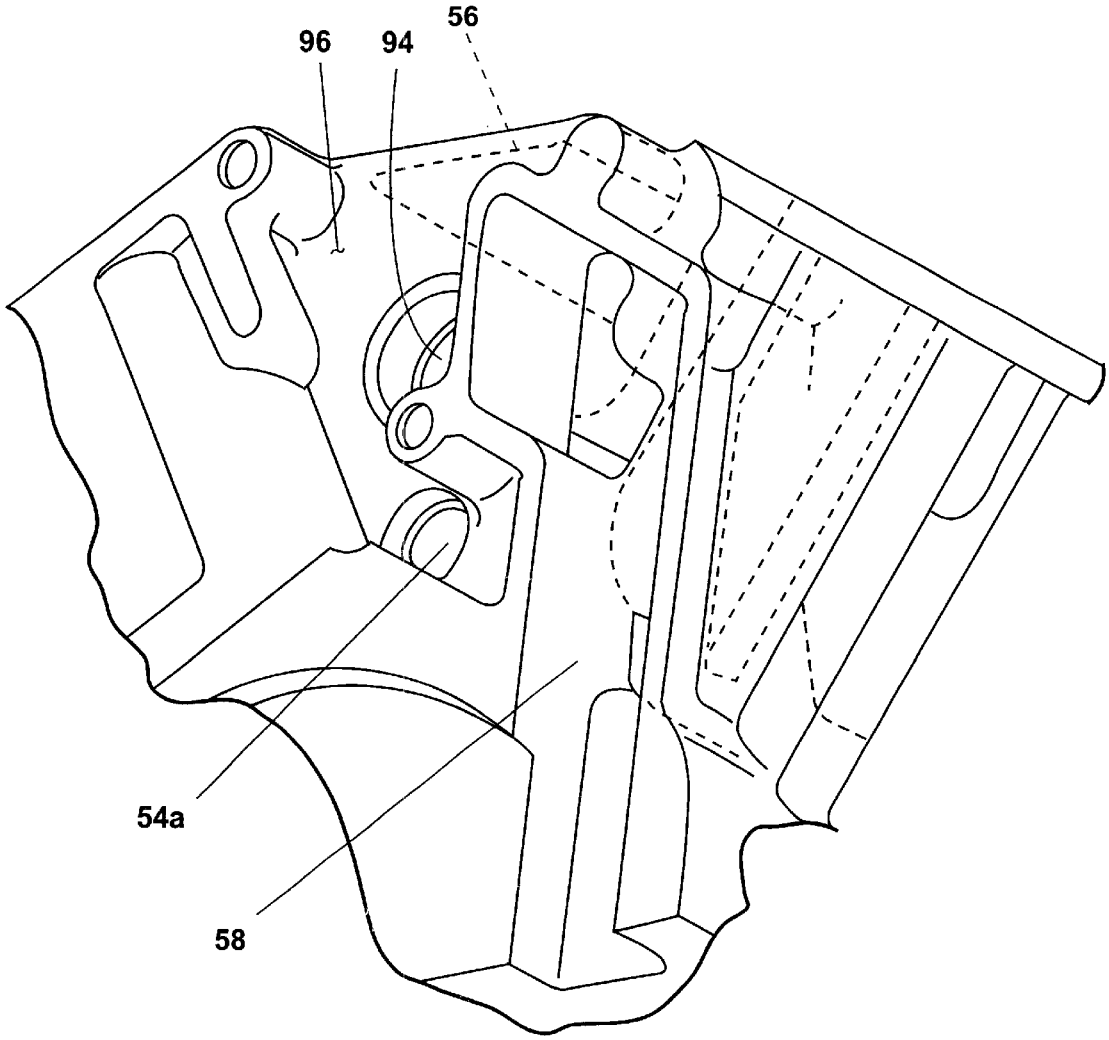
FIG. 4 is an alternative perspective view of the engine block detailing a return flow channel of the oil conditioning system.
Figure 5:
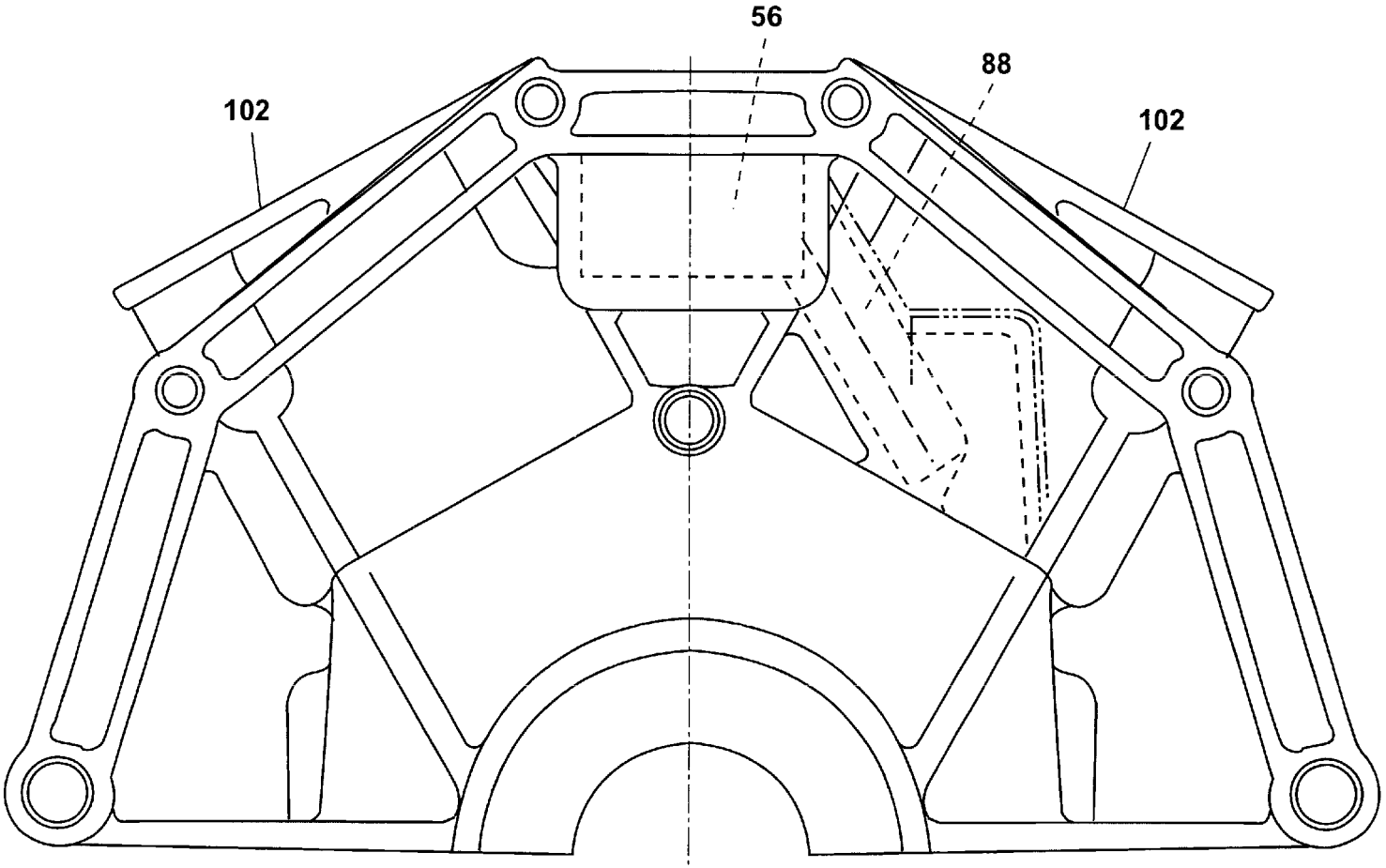
FIG. 5 is a rear view of the engine block.

With particular reference to FIG. 4, the engine block 12 further includes the oil dump channel 58, which provides fluid communication between the oil trough 56 and the crank case 50 or oil pan 18. In this manner, oil collecting within the oil trough 56 flows through the oil dump channel 88, back into the oil pan 18. This flow path avoids the problems associated with dripping of the oil onto the rotating crankshaft 62, as discussed above for push-rod type ICEs. With respect to overhead camshaft ICEs, the configuration of the present invention relieves the need for outboard drain back channels that would otherwise increase packaging size. Multiple oil dump channels are preferably provided for flow of oil from the oil trough 56. With reference to FIG. 5, a portion of a back face of the engine block 12 is shown, detailing a second oil dump channel 88 formed at a back end of the oil trough 56.

Optionally, a cylinder head oil dump channel 90 is provided for enabling fluid communication directly between the cylinder heads 14 and the oil pan 18. A portion of the oil within the cylinder heads 14 can thereby flow from the cylinder heads 14, directly into the oil pan 18, bypassing the oil trough 56. In this manner, post-operation oil remaining within pockets of the cylinder head 14, such as the pocket 92, may be reduced while still maintaining a minimal reservoir for aiding lubrication of the various valve train components at start-up of the ICE 10.

The coolant flow channels 52 of the engine block 12 include a main inlet 94 formed in a front face 96 of the engine block 12, directing coolant flow down coolant flow channels 52 disposed between the oil trough 56 and the combustion chambers 20, generally forming a coolant valley 98 below the oil trough 56. The oil trough 56 is in heat transfer communication with the coolant valley 98 through a formed wall 100. Further coolant flow channels 52 extend upward around the pistons 20 and are in fluid communication with the respective coolant flow channels 36 of the cylinder heads 14. The coolant flow channels 36 of the cylinder heads 14 include outside flow channels 36*a* that enable improved cooling on the outside of the ICE 10, which is beneficial by minimizing the effect of the high temperature exhaust gases escaping therefrom. Formation of the outside flow channels 36*a* is aided by near horizontal separation walls between the cavities 72 and the coolant flow channels 36, in conjunction with angular top faces 102 of the engine block 12, to which the cylinder heads 14 connect. Because the top faces 102 are formed at an angle relative to a vertical centerline X of the engine block 12, as opposed to orthogonal thereto, increased volume within the cylinder head 14 is provided for enabling the formation of the larger, outside coolant flow channels 36*a*. The near horizontal separation wall further results in a reduction in coolant area on the intake side, thereby reducing coolant volume where the cooling demand is less.

It is further anticipated that crankcase pressure may be relieved by venting pressure to the intake manifold 16 through the oil trough 56. To achieve this, an oil separator 104 is implemented between the oil trough 56 and the intake manifold 16, providing a fluid path therebetween. The oil separator 104 is preferably supported by the cover 84. Crankcase vapor (containing oil mist) in the oil trough 56 may be directed through the oil separator 104 and into the intake manifold 16 for assisting pressure relief to seals of the ICE 10 and the collection and drain back of oil mist to the oil trough 56.

As discussed above, at start-up, oil within traditional ICEs is at a temperature significantly lower than a desired operational temperature, resulting in increased friction and fuel consumption due to the significant time required for the oil to achieve the operational temperature. Further, for traditional ICEs, during normal operation, it is possible for the oil to achieve a temperature above the desired operational temperature. Both of these characteristics of traditional ICEs are undesirable.

With the ICE 10 configured as described herein, the oil therewithin may be conditioned for improved performance of the ICE. More specifically, at start-up, the coolant heats up much quicker than the oil. Thus, as oil flows through the oil trough 56, it is heated by the heat exchange relationship with the coolant surrounding the oil trough 56. In this manner, the oil attains an operational temperature more quickly than traditional ICEs. Further, during normal operational, the oil is maintained at the desired operational temperature again by the heat exchange relationship between the oil trough 56 and the surrounding coolant flow, whereby the coolant flow cools the oil within the oil trough 56.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An engine block for implementation with an internal combustion engine having a plurality of coolant and oil flow channels formed therein, an oil pan and at least one cylinder head in fluid communication with the coolant and oil flow channels, the engine block comprising:

at least one crank case bay formed therein;

at least one cylinder formed therein, wherein a plurality of the coolant flow channels run adjacent to said cylinder for cooling;

an oil trough disposed adjacent to the plurality of coolant flow channels running adjacent to said cylinder, said oil trough in heat transfer relationship with the plurality of coolant flow channels;

an oil return flow channel formed therein and enabling fluid communication between the at least one cylinder head and said oil trough, said oil return flow channel adjacent to the plurality of coolant flow channels running adjacent to said oil trough; and an oil dump flow channel enabling fluid communication between said oil trough and the oil pan, wherein oil from the cylinder head flows through said oil return flow channel into said oil trough for heat transfer with coolant in said adjacent coolant flow channels and through said oil dump flow channel to the oil pan.

2. The engine block according to claim 1, further comprising a venting channel formed therein for enabling fluid communication between said at least one crank case bay and said oil trough, wherein said venting channel enables pressurized fluid flow to said oil trough for equalizing pressure within said crank case bay.

3. An internal combustion engine, comprising:

a cylinder head having a first coolant flow channel formed therein and a first oil flow channel formed therein;

an engine block, comprising:

a plurality of cylinders formed therein;

a plurality of crank case bays formed therein, each crank case bay corresponding to at least one of said plurality of cylinders;

a second coolant flow channel formed therein and adjacent to said cylinders;

an oil trough formed therein adjacent to said second coolant flow channel and in heat transfer relationship therewith;

an oil return flow channel formed therein for providing fluid communication between said first oil flow channel of said cylinder head and said oil trough, said oil return flow channel adjacent to said second coolant flow channel and in heat transfer relationship therewith; and an oil dump flow channel formed therein for providing fluid communication from said oil trough;

an oil pan in sealed engagement with said engine block and in fluid communication with said oil dump flow channel, said oil pan for collecting oil, wherein the oil is pumped to said first oil flow channel of said cylinder head and flows from said cylinder head through said oil return flow channel and into said oil trough for heat transfer with coolant in said second coolant flow channel before returning to said oil pan through said oil dump flow channel.

4. The internal combustion engine according to claim 3, further comprising a plurality of venting channels formed within said engine block, each providing fluid communication between said plurality of crank case bays and said oil trough, wherein said venting channels enable pressurized fluid flow to said oil trough for equalizing pressure across said plurality of crank case bays.

5. The internal combustion engine according to claim 3, further comprising:

an inlet manifold in fluid communication with said cylinder head; and an oil separator providing fluid communication between said oil trough and said inlet manifold for enabling pressure flow into said inlet manifold.

* * * * *